US007152288B1

(12) United States Patent
Sanderson et al.

(10) Patent No.: US 7,152,288 B1
(45) Date of Patent: Dec. 26, 2006

(54) STUFFER BOX CRIMPER AND A METHOD FOR CRIMPING

(75) Inventors: William S. Sanderson, Blacksburg, VA (US); Donald T. Stilwell, Princeton, WV (US)

(73) Assignee: Celanese Acetate LLC, Dallas, TX (US)

( * ) Notice: Subject to any disclaimer, the term of this patent is extended or adjusted under 35 U.S.C. 154(b) by 0 days.

(21) Appl. No.: 11/176,870

(22) Filed: Jul. 7, 2005

(51) Int. Cl.
*D02G 1/12* (2006.01)

(52) U.S. Cl. ..... 28/263; 28/264

(58) Field of Classification Search ..... 28/263, 28/264, 265, 266–270, 262, 258, 221, 271, 28/273, 274, 276, 253, 254, 257; 264/168, 264/210.8, 211.14, 211.15, 282, 283, 292; 425/169, 336, 369
See application file for complete search history.

(56) References Cited

U.S. PATENT DOCUMENTS 2,794,239 A * 6/1957 Crawford et al. ..... 28/283
3,120,692 A * 2/1964 Crawford et al. ..... 28/265
3,220,083 A * 11/1965 Crawford et al. ..... 28/269
3,226,795 A * 1/1966 Swerdloff et al. ..... 28/258
3,237,270 A * 3/1966 Dennis ..... 28/269
3,296,677 A * 1/1967 Chase ..... 28/255
3,561,082 A * 2/1971 Stanley ..... 28/281
3,636,149 A * 1/1972 Tambini ..... 28/281
4,006,517 A * 2/1977 Izawa et al. ..... 28/269
4,395,804 A * 8/1983 Saxon et al. ..... 28/269
4,521,944 A * 6/1985 Stockbridge ..... 28/264
5,105,513 A * 4/1992 Marx et al. ..... 28/263
6,351,877 B1 * 3/2002 Harris et al. ..... 28/263

* cited by examiner

*Primary Examiner*—Amy B. Vanatta
(74) *Attorney, Agent, or Firm*—Hammer & Hanf, P.C.

(57) ABSTRACT

The instant invention is a stuffer box crimper and a method for crimping. The stuffer box crimper according to instant invention includes a pair of nip rollers, a pair of doctor blades, and a stuffer box. The pair of doctor blades is adjacent to an exit end of the pair of nip rollers. The stuffer box includes a stuffer box channel adjacent to the pair of doctor blades, and the stuffer box channel includes a surface consisting of a hard material having a hardness of at least 60 Rc. The method of crimping according to instant invention includes the steps of (1) providing a stuffer box crimper including a stuffer box having a stuffer box channel including a surface consisting of a hard material having a hardness of at least 60 Rc; and (2) crimping via the stuffer box crimper.

21 Claims, 6 Drawing Sheets

STUFFER BOX CRIMPER AND A METHOD FOR CRIMPING

FIELD OF INVENTION

The instant application relates to a stuffer box crimper, and a method for crimping.

BACKGROUND OF THE INVENTION

The use of stuffer box crimpers to crimp synthetic fibers is generally known. Crimp is a waviness imparted to synthetic fibers during manufacture, and crimp level may be measured as crimps per unit of length, e.g. crimps per inch.

A conventional stuffer box crimper generally comprises a pair of cooperating cylindrical parallel nipping rollers forming a nip, a stuffer box, and a pair of cheek plates in contact with the lateral side surfaces of the nipping rollers to prevent the lateral egress of the fibers.

In general, synthetic fibers are pulled through a pair of nip rollers and forced into a stuffer box including, for example, a channel and a flapper at a distal end of the channel. The synthetic fibers are folded perpendicular to their direction of travel as they encounter the backpressure caused by the force stuffing the synthetic fibers against the flapper; thereby forming the crimped synthetic fibers.

A stuffer box may have a short life span due to the abrasive wear between the surface of the stuffer box and the synthetic fibers. The continuous requirement to replace the worn-out stuffer box is costly, and the friction and stick-slip behavior between the surface of the stuffer box and the synthetic fibers may also affect crimp uniformity.

Different techniques have been employed to achieve uniform crimped synthetic fibers to improve other characteristics thereof. For example, in filter tow production, uniform crimped tow may be employed to influence the openability of the tow, or the pressure drop or pressure drop ("PD") variability of the filter rods made from such tow.

PD variability, a filter rod quality, refers to the PD uniformity of a large number of rods, and it is quantified by a Cv (coefficient of variation). Openability, a tow quality, refers to the ease of opening in the rodmaking equipment to completely deregister, or "bloom," the tow. Openability is seldom quantified, but it is readily apparent.

Despite the efforts invested in developing stuffer box crimpers, there is a still a need for a cost effective stuffer box crimper with a longer wear-life, which facilitates the production of uniform crimped synthetic fibers. Furthermore, there is still a need for a cost effective method of crimping, which facilitates the production of uniform crimped synthetic fibers.

SUMMARY OF THE INVENTION

The instant invention is a stuffer box crimper and a method for crimping. The stuffer box crimper according to instant invention includes a pair of nip rollers, a pair of doctor blades, and a stuffer box. The pair of doctor blades is adjacent to an exit end of the pair of nip rollers. The stuffer box includes a stuffer box channel adjacent to the pair of doctor blades, and the stuffer box channel includes a surface consisting of a hard material having a hardness of at least 60 Rockwell C-scale ("Rc"). The method of crimping according to instant invention includes the steps of (1) providing a stuffer box crimper including a stuffer box having a stuffer box channel including a surface consisting of a hard material having a hardness of at least 60 Rockwell C-scale ("Rc"); and (2) crimping via the stuffer box crimper.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
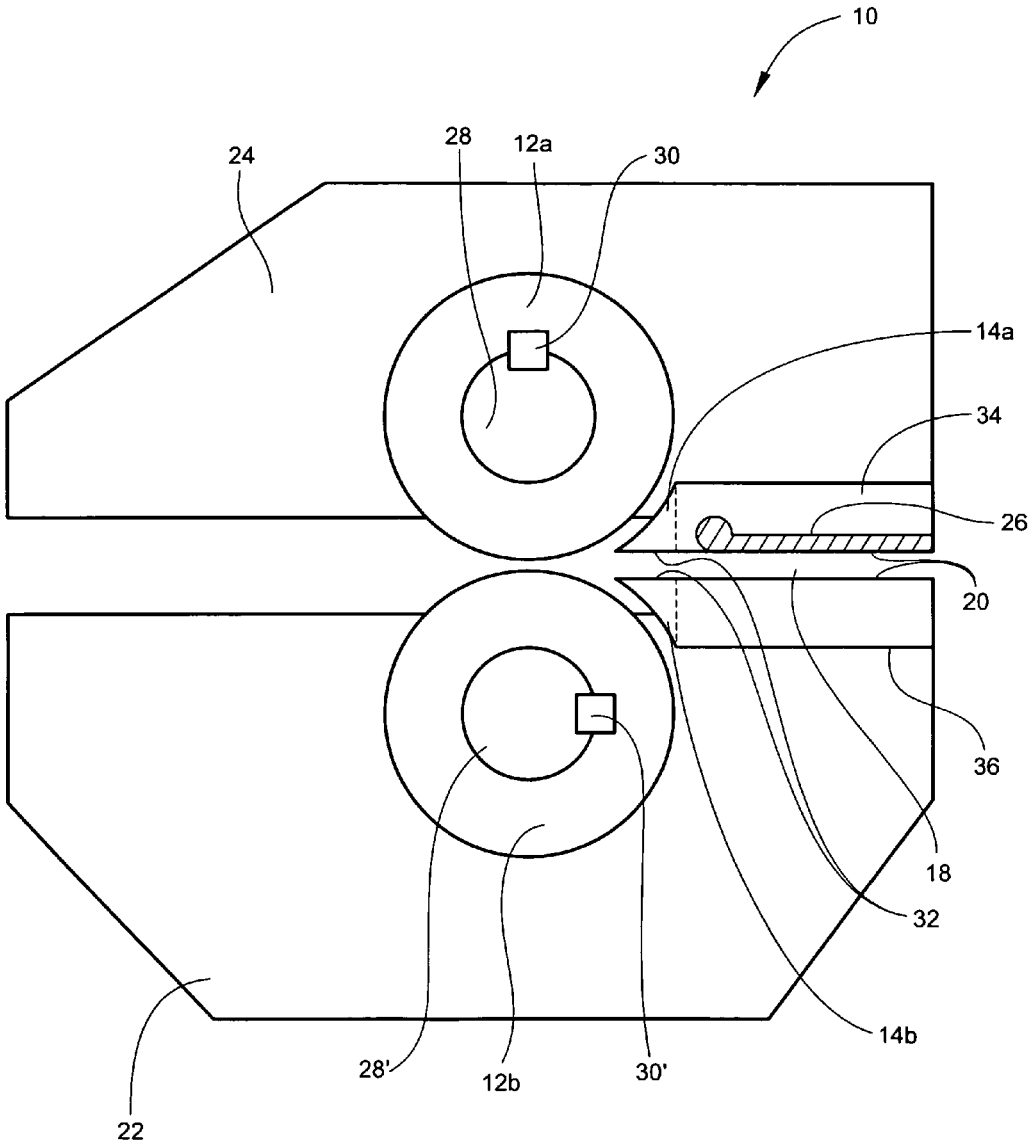
FIG. 1 is a side elevational view of a stuffer box crimper made according to instant invention, parts broken away for clarity.
Figure 2:
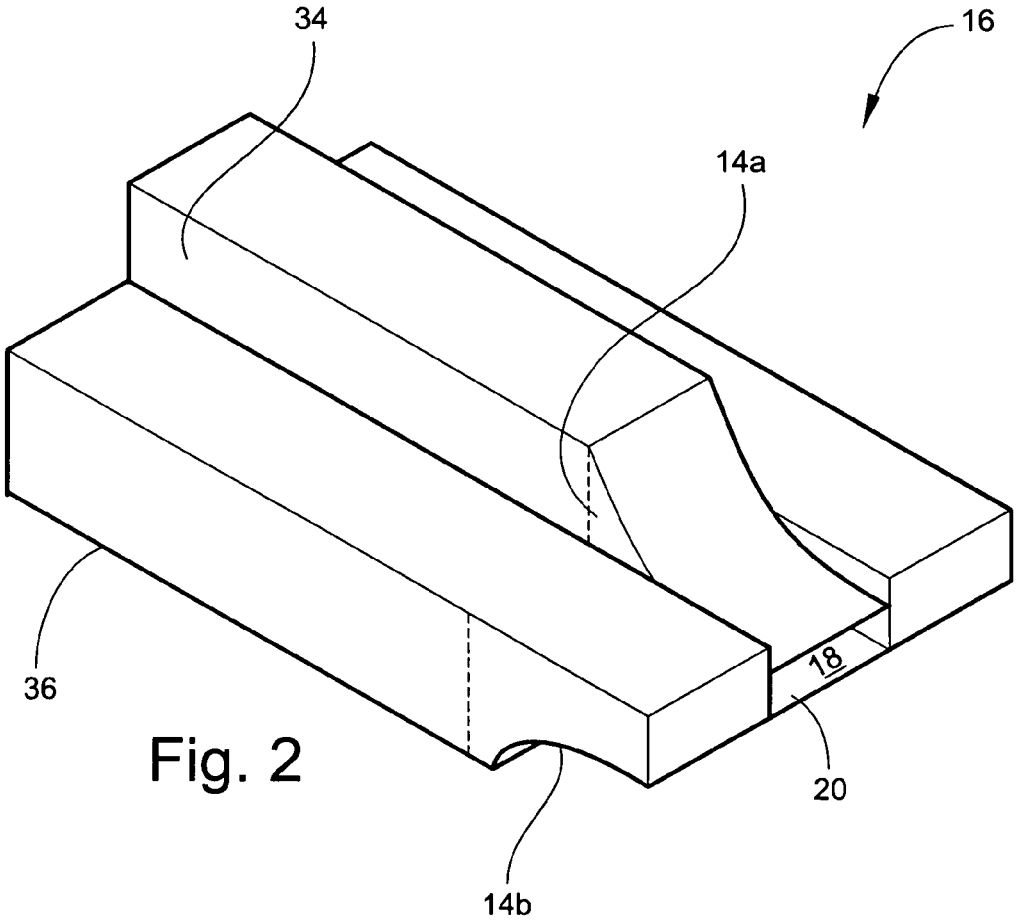
FIG. 2 is perspective view of stuffer box according to instant invention.
Figure 3:
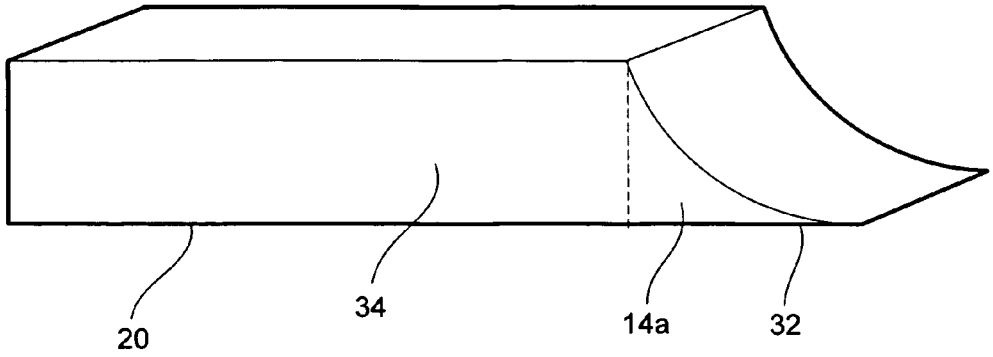
FIG. 3 is an upper perspective view of the upper half of the stuffer box of FIG. 2.
Figure 4:
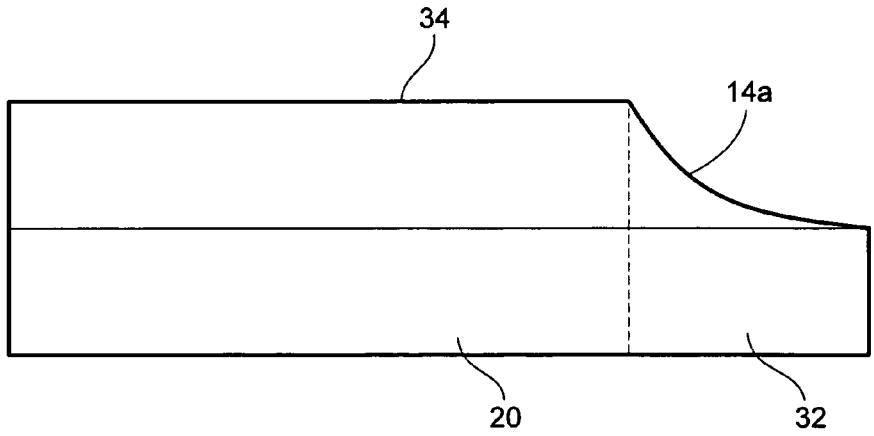
FIG. 4 is a lower perspective view of the upper half of the stuffer box of FIG. 2.
Figure 5:
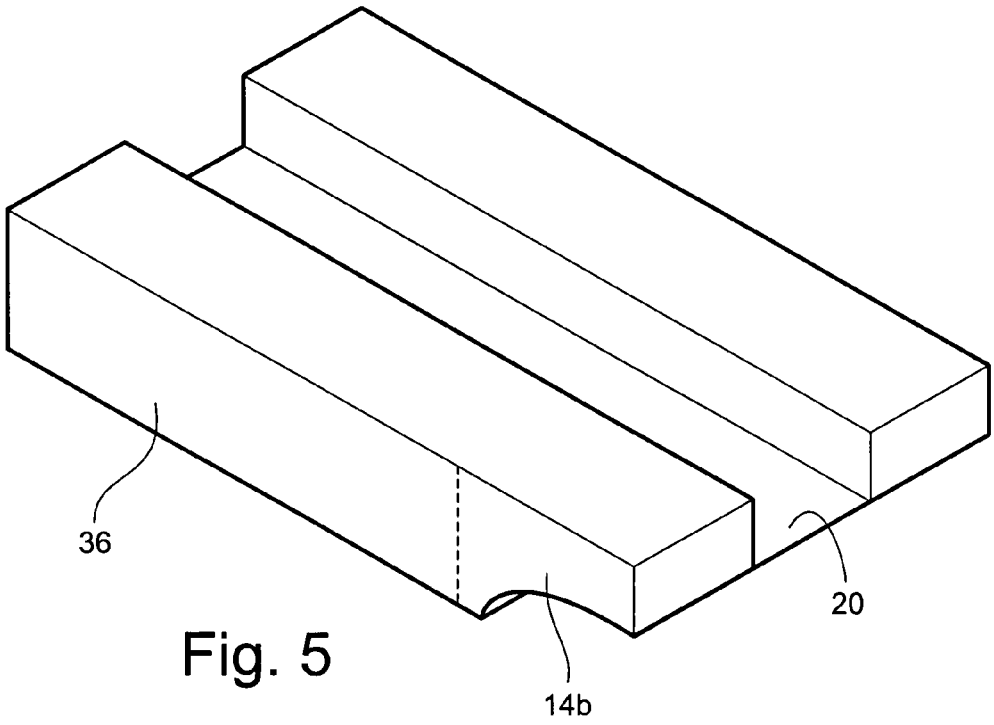
FIG. 5 is a perspective view of the lower half of the stuffer box of FIG. 2.
Figure 6:
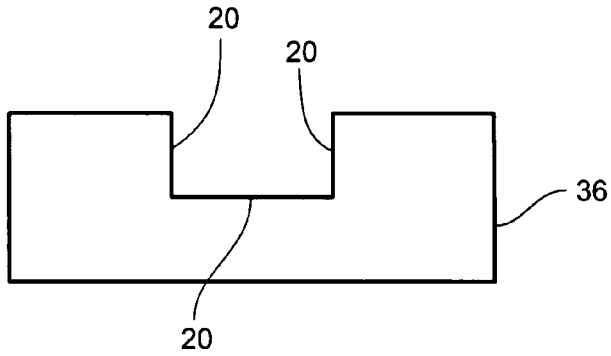
FIG. 6 is a posterior view of the lower half of the stuffer box of FIG. 2.
Figure 7:
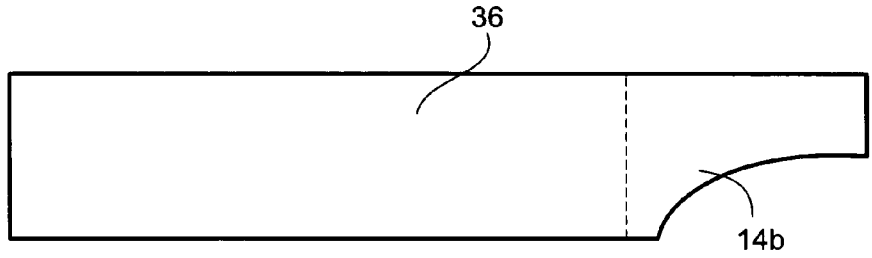
FIG. 7 is an elevational side view of the lower half of the stuffer box of FIG. 2.
Figure 8:
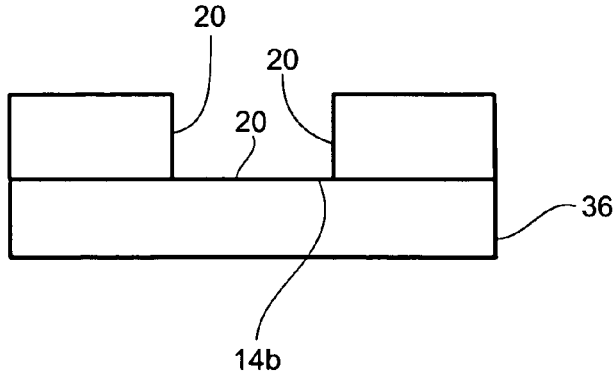
FIG. 8 is an anterior view of the lower half of the stuffer box of FIG. 2.

Referring to the drawings wherein like numerals indicate like elements, there is shown, in FIGS. 1–2, a preferred embodiment of a stuffer box crimper 10. Stuffer box crimper 10 includes at least one pair of nip rollers 12, a pair of doctor blades 14, and a stuffer box 16. Stuffer box 16 includes a stuffer box channel 18, which has a surface 20 consisting of a hard material having a hardness of at least 60 Rockwell C-scale ("Rc"). The stuffer box crimper 10 may further include a pair of cheek plates (not shown), a base frame 22, a top frame 24, and a flapper 26.

The instant application, for convenience, is further discussed with regard to cellulose acetate tow production; however, the instant invention is not so limited, and it may include the production of any synthetic fiber.

A wide range of different test methods and instruments may be employed to measure the fiber to surface dynamic coefficient of friction and fiber to surface stick-slip frequency, and such test methods and instruments are generally known and commercially available. However, as mentioned hereinbelow, the fiber to surface dynamic coefficient of friction and fiber to surface stick-slip frequency was measured via an F-meter using commercially available test standard methods therefor, provided by Rothschild Instruments, Zurich, Switzerland.

Referring to FIG. 1, the pair of nip rollers 12 are generally known to a person of ordinary skill in the art. The pair of nip rollers 12 includes at least one upper nip roller 12*a*, and at least one lower nip roller 12*b*. The upper nip roller 12*a* is mounted on the top frame 24 via shaft 28, and it is fixed in place via key 30. The lower nip roller 12*b* is mounted on the base frame 22 via shaft 28', and it is fixed in place via key 30'. Base frame 22 and top frame 24 are coupled together in a conventional manner, and top frame 24 may move in relation to the base frame 22.

Referring to FIGS. 1–5, doctor blades are generally known to a person of ordinary skill in the art. Doctor blades 14 include at least one upper doctor blade 14*a* and a lower doctor blade 14*b*. Doctor blades 14 may have any size or any shape. For example, doctor blades 14 may have a size or a shape adapted to prevent synthetic fibers, e.g. tow, from sticking to the pair of nip rollers 12. Doctor blades 14 may be made of any material. Doctor blades 14 may at least include one blade surface 32 consisting of a hard material having a hardness of at least 60 Rc. The hard material of surface 32 may, for example, have a fiber to surface dynamic coefficient of friction of less than 0.35, or a fiber to surface stick-slip frequency of at least 5 per 30 seconds. For example, the hard material of blade surface 32 may have a fiber to surface dynamic coefficient of friction of less than 0.30, or a fiber to surface stick-slip frequency of at least 10 per 30 seconds. In the alternative, the hard material of blade surface 32 may have a fiber to surface dynamic coefficient of friction of less than 0.25, or a fiber to surface stick-slip frequency of at least 20 per 30 seconds. For example, blade surface 32 may be made of a material selected from the group consisting of cemented carbides, refractory metal carbides, coated cemented carbides, ceramics, cast super alloys, nitrides, borides, oxides, diamonds, and combinations thereof. Exemplary listed materials are not regarded as limiting. Exemplary cemented carbides, as used herein, include, but are not limited to, tungsten carbide, titanium carbide, chromium carbide, boron carbide, and iron carbide. Exemplary listed carbides are not regarded as limiting. Ceramics, as used herein, include, but are not limited to, aluminum ceramics. Exemplary listed ceramics are not regarded as limiting. The blade surface 32 may be an integral component of doctor blades 14; or in the alternative, blade surface 32 may be a coating or an insert. The coating may have any thickness; for example, the coating may have a thickness adapted to withstand long-term abrasion and to provide structural integrity, e.g. greater than 1μ. The coating may be applied via conventional methods including, but not limited to, spraying, plating, vapor phase deposition, ion implantation, and combinations thereof. The insert may have any thickness; for example, the insert may have a thickness adapted to withstand long-term abrasion and to provide structural integrity. The insert may be affixed to doctor blades 14 via different methods including, but not limited to, diffusion bonding, bolting, welding, soldering, brazing, gluing, interlocking mechanisms, combinations thereof, and the like. Exemplary listed methods are not regarded as limiting. Doctor blades 14 may be placed at any location in relation to the upper and lower nip rollers 12*a* and 12*b*, respectively. For example, doctor blades 14 may be placed next to the upper and the lower nip roller 12*a* and 12*b*, e.g. with a clearance of about 1 mil from the upper and lower nip rolls 12*a* and 12*b*, to prevent the synthetic fibers, e.g. tow, from sticking to the pair of nip rollers 12. Doctor blades 14 may be an integral component of the stuffer box 16, as explained in more details hereinbelow; or in the alternative, it may be a separate component coupled to the stuffer box crimper 10, e.g. coupled to the stuffer box 16 via conventional methods including, but not limited to, diffusion bonding, bolting, welding, soldering, brazing, gluing, interlocking mechanisms, combinations thereof, and the like.

Referring to FIGS. 1–8, the stuffer box 16 may be a single piece; or in the alternatives, it may include more than one piece. For example, stuffer box 16 may have two complementary halves, e.g. an upper half 34 and a lower half 36. The upper half 34 may be affixed to the top frame 24, and the lower half 36 may be affixed to the base frame 22. The halves, i.e. upper half 34 and lower half 36, when matched define a stuffer box channel 18. Stuffer box 16 may be made of any material. Stuffer box 16 may be made of a hard material having a hardness of at least 60 Rc, a fiber to surface dynamic coefficient of friction of less than 0.35, or a fiber to surface stick-slip frequency of at least 5 per 30 seconds. The stuffer box 16 may, for example, be made of a material having a fiber to surface dynamic coefficient of friction of less than 0.30, or a fiber to surface stick-slip frequency of at least 10 per 30 seconds. In the alternative, stuffer box 16 may be made of a material having a fiber to surface dynamic coefficient of friction of less than 0.25, or a fiber to surface stick-slip frequency of at least 20 per 30 seconds. For example, stuffer box 16 may be made of a material selected from the group consisting of cemented carbides, refractory metal carbides, coated cemented carbides, ceramics, cast super alloys, nitrides, borides, oxides, diamonds, and combinations thereof. Exemplary listed materials are not regarded as limiting. In the alternative, stuffer box 16 may at least have one channel surface 20 consisting of a material having a hardness of at least 60 Rc, a fiber to surface dynamic coefficient of friction of less than 0.30, or a fiber to surface stick-slip frequency of at least 5 per 30 seconds; thereby providing the stuffer box channel 18 with at least one channel surface 20 consisting of a material having a hardness of at least 60 Rc, a fiber to surface dynamic coefficient of friction of less than 0.35, or a fiber to surface stick-slip frequency of at least 5 per 30 seconds. The hard material of channel surface 20 may, for example, have a fiber to surface dynamic coefficient of friction of at least 0.30, or a fiber to surface stick-slip frequency of at least 10 per 30 seconds. In the alternative, the hard material of channel surface 20 may have a fiber to surface dynamic coefficient of friction of at least 0.25, or a fiber to surface stick-slip frequency of at least 20 per 30 seconds. For example, channel surface 20 may be made of a material selected from the group consisting of cemented carbides, refractory metal carbides, coated cemented carbides, ceramics, cast super alloys, nitrides, borides, oxides, diamonds, and combinations thereof. Exemplary listed materials are not regarded as limiting. The channel surface 20 may be an integral component of the stuffer box 16; or in the alternative, channel surface 20 may be a coating or an insert. The coating may have any thickness; for example, the coating may have a thickness adapted to withstand long-term abrasion and to provide structural integrity, e.g. 1μ. The coating may be applied via conventional methods, for example, spraying, plating, vapor phase deposition, ion implantation, and combinations thereof. The insert may have any thickness; for example, the insert may have a thickness adapted to withstand long-term abrasion and to provide structural integrity. The insert may be affixed to the stuffer box 16 via different methods including, but not limited to, diffusion bonding, bolting, welding, soldering, brazing, gluing, interlocking mechanisms, combinations thereof, and the like. Exemplary listed methods are not regarded as limiting. Diffusion bonding, as used herein, refers to a process wherein heat and pressure are employed to fuse the insert to, for example, the stuffer box 16. Channel surface 20 is important because it improves upon the stick-slip properties of the stuffer box 16 thereby facilitating the formation of uniform crimps while extending the wear life of the stuffer box 16. As discussed hereinabove, doctor blades 14 may be an integral component of stuffer box 16, or in the alternative, it may be a separate component coupled to stuffer box 16. Doctor blades 14 may be made of any material, as discussed hereinabove. For example, doctor blades 14 may be made of the same material as stuffer box 16; or in the alternative, only blade surface 32 of the doctor blades 14 may be complimentary to the channel surface 20 of the stuffer box 16, e.g. having a hardness of at least 60 Rc, a fiber to surface dynamic coefficient of friction of less than 0.35, or a fiber to surface stick-slip frequency of at least 5 per 30 seconds.

Referring to FIGS. 1–8, stuffer box channel 18 may have any size or any shape. Stuffer box channel 18 may have a shape or a size adapted to facilitate uniform crimping.

Stuffer box crimper 10 may further include a pair of cheek plates (not shown) to prevent the lateral egress of the synthetic fibers, e.g. tow from stuffer box crimper 10. Cheek plates are generally known to a person skilled in the art.

Stuffer box crimper 10 may further include a flapper 26, which is adapted to bearingly engage the synthetic fibers, e.g. tow, to facilitate the formation of uniform crimps. Flapper 26 may be mounted on the upper half 34 of the stuffer box 16 via a pivot (not shown), so that flapper 26 may swing into stuffer box channel 18 and partially close the same. Movement of flapper 26 may be controlled via an actuator (not shown), which is operatively coupled to flapper 26. Movement of the flapper 26 may be controlled to insure crimp uniformity via any conventional means including, but not limited to, weight, pneumatic, electrical, or electronic means. Flapper 26 may be made of a hard material having a hardness of at least 60 Rc, a fiber to surface dynamic coefficient of friction of less than 0.35, or a fiber to surface stick-slip frequency of at least 5 per seconds. The flapper 26 may, for example, be made of a material having a fiber to surface dynamic coefficient of friction of less than 0.30, or a fiber to surface stick-slip frequency of at least 10 per 30 seconds. In the alternative, flapper 26 may be made of a material having a fiber to surface dynamic coefficient of friction of less than 0.25, or a fiber to surface stick-slip frequency of at least 20 per 30 seconds. For example, flapper 26 may be made of a material selected from the group consisting of cemented carbides, refractory metal carbides, coated cemented carbides, ceramics, cast super alloys, nitrides, borides, oxides, diamonds, and combinations thereof. Exemplary listed materials are not regarded as limiting. In the alternative, flapper 26 may at least have one surface consisting of a material having a hardness of at least 60 Rc, a fiber to surface dynamic coefficient of friction of less than 0.30, or a fiber to surface stick-slip frequency of at least 5 per 30 seconds. The hard material of the surface of flapper 26 may, for example, have a fiber to surface dynamic coefficient of friction of at least 0.30, or a fiber to surface stick-slip frequency of at least 10 per 30 seconds. In the alternative, the hard material of the surface of flapper 26 may have a fiber to surface dynamic coefficient of friction of at least 0.25, or a fiber to surface stick-slip frequency of at least 20 per 30 seconds. For example, the surface of flapper 26 may be made of a material selected from the group consisting of cemented carbides, refractory metal carbides, coated cemented carbides, ceramics, cast super alloys, nitrides, borides, oxides, diamonds, and combinations thereof. Exemplary listed materials are not regarded as limiting. The surface of flapper 26 may be an integral component of the flapper 26; or in the alternative, the surface of flapper 26 may be a coating or an insert. The coating may have any thickness; for example, the coating may have a thickness adapted to withstand long-term abrasion and to provide structural integrity, e.g. 1μ. The coating may be applied via conventional methods, for example, spraying, plating, vapor phase deposition, ion implantation, and combinations thereof. The insert may have any thickness; for example, the insert may have a thickness adapted to withstand long-term abrasion and to provide structural integrity. The insert may be affixed to the flapper 26 via different methods including, but not limited to, diffusion bonding, bolting, welding, soldering, brazing, gluing, interlocking mechanisms, combinations thereof, and the like. Exemplary listed methods are not regarded as limiting.

The stuffer box crimper 10 may further include a steam injector (not shown), an edge lubrication applicator (not shown), or plasticizing station (not shown). Steam injectors, edge lubrication applicators, and plasticizing station are generally know to a person skilled in the art.

Figure 9:
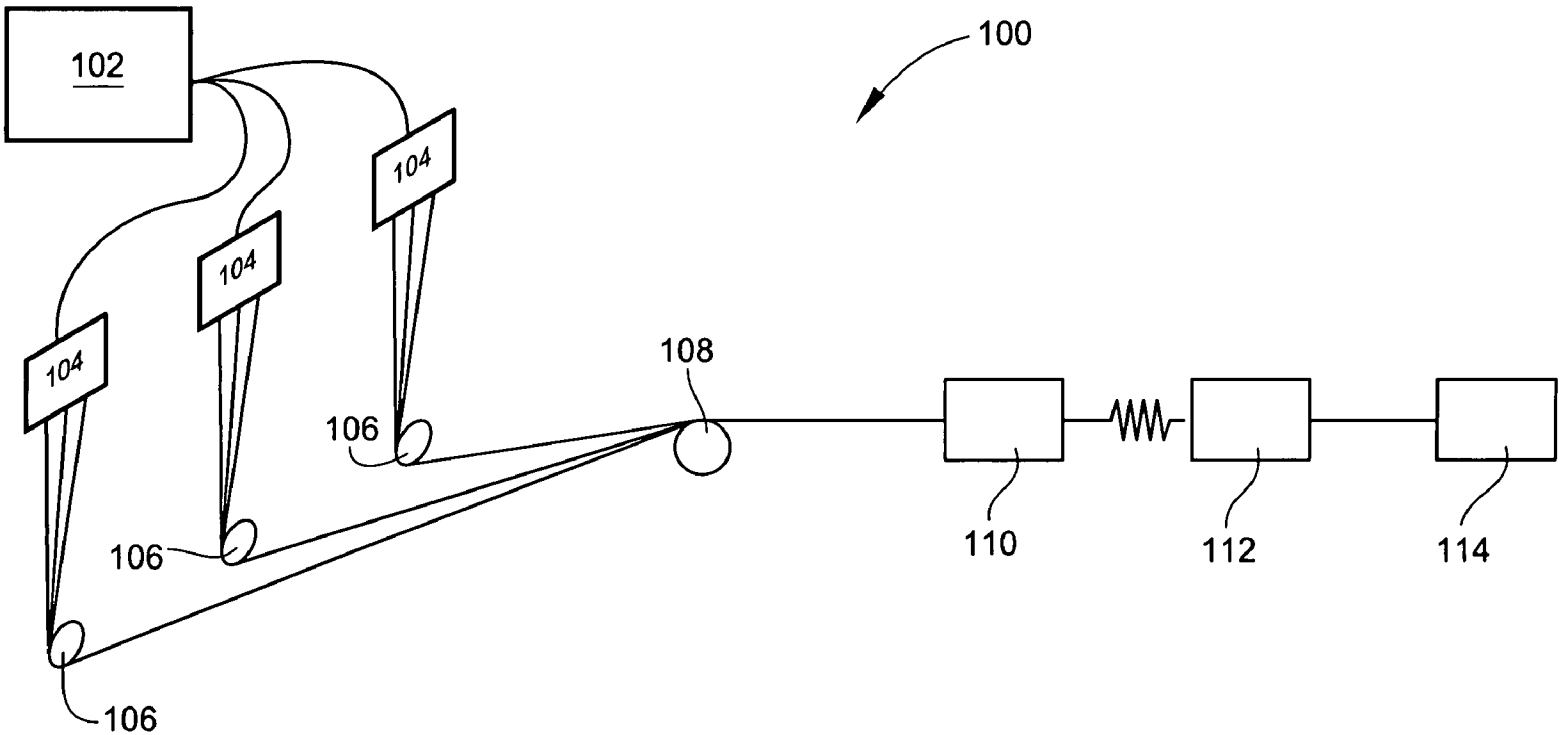
FIG. 9 is a schematic illustration of a tow production process according to the present invention.

Referring to FIGS. 1 and 9, tow process 100 is shown. Dope, i.e. a solution of a polymer, e.g. cellulose acetate, and solvent, e.g. acetone, is prepared in the dope preparation station 102. Dope preparation station 102 feeds to a plurality of cabinets 104 (only three shown, but not necessarily so limited). In cabinets 104, fibers are produced, in a conventional manner. The fibers are taken-up on take-up roller 106. These fibers may be lubricated at a lubrication station (not shown) with a finish. These lubricated fibers are then bundled together to form a tow on a roller 108. The tow may be plasticized at a plasticizing station (not shown). The tow is, subsequently, crimped in crimper 110 via a stuffer box crimper 10. The tow is engaged via a pair of nip rollers 12, and forced into the stuffer box 16. If a pair of cheek plates are present, they will maintain the tow between the upper and lower nip rollers 12*a* and 12*b*. The tow travels into the stuffer box channel 18 which includes a surface 20 consisting of a hard material having a hardness of 60 Rc. Flapper 26 swings into stuffer box channel 20 to partially close it. The movement of flapper 26 may be controlled, as explained hereinabove, to insure crimp uniformity. The tow is folded perpendicular to its direction of travel as it encounters the backpressure caused by the force stuffing the tow against the flapper 26; thereby forming the crimped tow. The crimped tow may then be dried in dryer 112; and subsequently, the dried crimped tow is bailed at baling station 114.

The present invention may be embodied in other forms without departing from the spirit and the essential attributes thereof, and, accordingly, reference should be made to the appended claims, rather than to the foregoing specification, as indicated the scope of the invention.

We claim:

1. A stuffer box crimper comprising:

a pair of nip rollers;

a pair of doctor blades adjacent to an exit end of said pair of nip rollers;

a stuffer box having a stuffer box channel defined between said pair of doctor blades and downstream thereof, wherein said channel including a channel surface consisting of a hard material having a hardness of at least 60 Rockwell C-scale; and a flapper located within said channel.

2. The stutter box crimper according to claim 1, wherein said pair of doctor blades having a blade surface consisting of said hard material.

3. The stuffer box crimper according to claim 1, wherein said flapper having a flapper surface consisting of said hard material.

4. The stuffer box crimper according to claim 1, wherein said hard material having a fiber to surface dynamic coefficient of friction of less than 0.35.

5. The stuffer box crimper according to claim 1, wherein said hard material having a fiber to surface stick-slip frequency of at least 5 per 30 seconds.

6. The stuffer box crimper according to claim 1, wherein said hard material being selected from the group consisting of cemented carbides, refractory metal carbides, coated cemented carbides, ceramics, cast super alloys, nitrides, borides, oxides, diamonds, and combinations thereof.

7. The stuffer box crimper according to claim 6, wherein said cemented carbide selected from the group consisting of tungsten carbide, titanium carbide, chromium carbide, boron carbide, and iron carbide.

8. The stuffer box crimper according to claim 1, wherein said channel surface being an integrated component of said stuffer box, a coating, or an insert.

9. The stuffer box crimper according to claim 2, wherein said blade surface being an integrated component of said pair of doctor blades, a coating on said doctor blades, or an insert affixed to said doctor blades.

10. The stuffer box crimper according to claim 3, wherein said flapper surface being an integrated component of said flapper, a coating on said flapper, or an insert affixed to said flapper.

11. A method for crimping comprising the steps of:

providing a stuffer box crimper comprising;

a pair of nip rollers;

a pair of doctor blades adjacent to an exit end of said pair of nip rollers;

a stuffer box having a stuffer channel defined between said pair of doctor blades and downstream thereof, wherein said channel including a surface consisting of a hard material having a hardness of at least 60 Rockwell C-scale; and a flapper located within said channel; and crimping via said stuffer box crimper.

12. The method for crimping according to claim 11, wherein said pair of doctor blades having a blade surface consisting of said hard material.

13. The method for crimping according to claim 11, wherein said flapper having a flapper surface consisting of said hard material.

14. The method for crimping according to claim 11, wherein said hard material having a fiber to surface dynamic coefficient of friction of less than 0.35.

15. The method for crimping according to claim 11, wherein said hard material having a fiber to surface stick-slip frequency of at least 5 per 30 seconds.

16. The method for crimping according to claim 11, wherein said hard material being selected from the group consisting of cemented carbides, refractory metal carbides, coated cemented carbides, ceramics, cast super alloys, nitrides, borides, oxides, diamonds, and combinations thereof.

17. The method for crimping according to claim 16, wherein said cemented carbide selected from the group consisting of tungsten carbide, titanium carbide, chromium carbide, boron carbide, and iron carbide.

18. The method for crimping according to claim 11, wherein said channel surface being an integrated component of said stuffer box, a coating, or an insert.

19. The method for crimping according to claim 12, wherein said blade surface being an integrated component of said pair of doctor blades, a coating on said doctor blades, or an insert affixed to said doctor blades.

20. The method for crimping according to claim 13, wherein said flapper surface being an integrated component of said flapper, a coating on said flapper, or an insert affixed to said flapper.

21. A method for making a cellulose acetate tow comprising the steps of:

spinning a dope comprising a solution of cellulose acetate and solvent;

taking-up said as-spun cellulose acetate filaments;

lubricating said cellulose acetate filaments;

forming a tow from said cellulose acetate filaments;

crimping said tow via a stuffer box crimper comprising;

a pair of nip rollers;

a pair of cheek plates juxtaposed to said pair of nip rollers;

a pair of doctor blades adjacent to an exit end of said pair of nip rollers;

a stuffer box having a stuffer channel defined between said pair of doctor blades and downstream thereof, wherein said channel including a surface consisting of a hard material having a hardness of at least 60 Rockwell C-scale; and a flapper located within said channel;

drying said crimped tow; and bailing said dried crimped tow.

* * * * *